US010366634B2

(12) United States Patent
Gibson

(10) Patent No.: US 10,366,634 B2
(45) Date of Patent: Jul. 30, 2019

(54) BACKLIGHTING EFFECT FOR PACKAGE DISPLAYS

(71) Applicant: Xerox Corporation, Norwalk, CT (US)

(72) Inventor: George A. Gibson, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 14 days.

(21) Appl. No.: 15/886,070

(22) Filed: Feb. 1, 2018

(65) Prior Publication Data

US 2018/0158378 A1 Jun. 7, 2018

Related U.S. Application Data

(63) Continuation of application No. 14/820,078, filed on Aug. 6, 2015, now Pat. No. 9,916,778.

(51) Int. Cl.

| | |
|---|---|
| ***G09F 3/10*** | (2006.01) |
| ***G09F 3/02*** | (2006.01) |
| ***G09F 13/20*** | (2006.01) |

(52) U.S. Cl.

CPC ..... *G09F 3/10* (2013.01); *G09F 3/02* (2013.01); *G09F 13/20* (2013.01); *G09F 2003/023* (2013.01); *G09F 2003/0241* (2013.01); *G09F 2003/0272* (2013.01); *Y10T 428/2984* (2015.01)

(58) Field of Classification Search

CPC ..... G03F 7/002; Y10T 428/2984; Y10T 428/2985; Y10T 428/249996; Y10T 428/249997; G09F 3/10; G09F 3/20

USPC ..... 428/321.3, 321.5, 402.2, 402.21

See application file for complete search history.

(56) References Cited

U.S. PATENT DOCUMENTS

| | | | | |
|---|---|---|---|---|
| 3,647,504 | A * | 3/1972 | Hayes, Jr. | B41M 5/165 428/320.2 |
| 4,635,166 | A | 1/1987 | Cameron | |
| 6,474,467 | B1 | 11/2002 | Kurdian | |
| 6,564,641 | B1 * | 5/2003 | Shigyo | G01L 1/24 73/705 |
| 2003/0141004 | A1 | 7/2003 | Palmblad et al. | |
| 2005/0068760 | A1 | 3/2005 | Goychrach | |
| 2006/0222806 | A1 | 10/2006 | Burchett | |
| 2014/0212654 | A1 * | 7/2014 | Clayton | B41M 5/165 428/323 |

FOREIGN PATENT DOCUMENTS

| | | | |
|---|---|---|---|
| WO | 2006115399 | A1 | 11/2006 |
| WO | 2007121519 | A1 | 11/2007 |

* cited by examiner

*Primary Examiner* — Scott W Dodds
(74) *Attorney, Agent, or Firm* — Fox Rothschild LLP

(57) ABSTRACT

A method of making a chemiluminescent label by creating an outer layer of the chemiluminiscent label, creating a bottom layer of the chemiluminiscent label, and fusing the outer layer and the bottom layer to form at least one cavity between the outer layer and the bottom layer. The outer layer includes an image with a first plurality of regions. The bottom layer includes an adhesion material on a side not proximate to the outer layer, and a second plurality of regions corresponding to the first plurality of regions that are configured to break at a plurality of different pressure values.

18 Claims, 3 Drawing Sheets

BACKLIGHTING EFFECT FOR PACKAGE DISPLAYS

RELATED APPLICATIONS AND CLAIM OF PRIORITY

This application is a continuation of U.S. patent application Ser. No. 14/820,078, entitled Backlighting Effect for Package Displays, filed on Aug. 6, 2015, the disclosure of which is fully incorporated into this document by reference.

BACKGROUND

Distinguishing consumer products, such as beverages, from those of competitors in an attractive and interesting manner increases sales and consumption of the product. In creating consumer products, the taste, smell, and visual appeal of a product and/or the product container may be optimized to appeal to a target market while maintaining economic viability of the product. While, products are often introduced in aggressively styled containers, once optimized such appeal oriented attributes, especially visual attributes, remain static. Consequently, consumers can quickly become inured to a product's visual appeal.

Dynamic and/or user interactive packing or illumination of a product container in an unusual and/or attractive manner could increase attention that yields higher sales conversions. Similarly, changing the coloration of a container or packaging in response to such an interaction would further increase consumer interest.

Pressure sensitive chemiluminescence has been known to provide illumination effects for beverage containers. Such containers create illumination when chemicals that are physically separated are introduced to each other creating a reaction that includes an illuminating chemiluminescent effect. However, current product containers or packages include two distinct chambers to separate the chemiluminescent compound from the activator compound, wherein the separation between the chambers breaks upon application of pressure to produce illumination. Moreover, these prior art methods are limited to one color illumination and do not provide user interaction beyond a single application of pressure. Furthermore, the user interactive product packaging must be suitable for mass production, marketing, durable, and economical. For example, it is desirable to produce chemiluminescent labels adaptable for use on any product container rather than customizing product containers.

Therefore, what is desired are means and/or devices to enhance to consumers the appeal of products sold in containers and for those means and/or devices to be simple, cost effective, and incorporate interaction between consumer and product. The current disclosure discloses a user interactive chemiluminescent product packaging, and methods for manufacturing the same.

SUMMARY

In one aspect of the disclosure, a method of making a chemiluminescent label may include creating an outer layer of the chemiluminiscent label, creating a bottom layer of the chemiluminiscent label, and fusing the outer layer and the bottom layer to form at least one cavity between the outer layer and the bottom layer. The outer layer may include an image with a first plurality of regions. The bottom layer may include an adhesion material on a side not proximate to the outer layer, and a second plurality of regions corresponding to the first plurality of regions that are configured to break at a plurality of different pressure values.

In an embodiment, the method may further include affixing the chemiluminescent label to a product container, via the bottom layer.

In certain embodiments, creating the outer layer further may include customizing the first plurality of regions based on at least one of the following: a product, a customer base, or a plurality user interactive features.

In an embodiment, the method may further include disposing an activator material on the side of the bottom layer comprising the adhesion material, and dispersing a plurality of chemiluminescent material particles in the at least one cavity. Optionally, the chemiluminiscent label may be configured to form an illumination comprising at least one color in at least one of the first plurality of regions by application of pressure on at least one of the second plurality of regions that causes the activator material to react with at least one of the plurality of chemiluminescent particles. In an embodiment, dispersing the plurality of chemiluminescent material particles in the at least one cavity may include dispersing the plurality of chemiluminescent material particles in the at least one cavity to correspond to the second plurality of regions such that one or more colors of chemiluminescence are produced upon application of pressure at one or more of the plurality of different pressure values in the first plurality of regions.

In another embodiment, the method may further include disposing an activator material in the at least one cavity, and dispersing a plurality of chemiluminescent material particles on the bottom layer on the side comprising the adhesion material.

In another aspect, a method of making a chemiluminescent label may include creating an outer layer of the chemiluminiscent label, creating a bottom layer of the chemiluminiscent label, fusing the outer layer and the bottom layer to form at least one cavity between the outer layer and the bottom layer, and disposing a plurality of microcapsules in the at least one cavity wherein the outer layer comprises an image with a first plurality of regions. The bottom layer may include an adhesion material on a side not proximate to the outer layer, and the plurality of microcapsules are configured to break at a plurality of different pressure values. The bottom layer may include a plurality of regions that break at a plurality of different pressure values.

In certain embodiments, the methods may further include disposing an activator material on the side of the bottom layer comprising the adhesion material, and disposing a plurality of chemiluminescent material particles in the plurality of microcapsules. An application of pressure on the chemilumiscent material may cause the activator material to react with at least one of the plurality of chemiluminescent particles to cause formation of an illumination. Additionally and/or alternatively, the plurality of microcapsules produce a plurality of different colors of chemiluminescence, and disposing the plurality of microcapsules in the at least one cavity may include disposing the plurality of microcapsules in the at least one cavity to correspond to the first plurality of regions such that that one or more colors of chemiluminescence are produced upon application of pressure at one or more of the plurality of different pressure values in the first plurality of regions.

In an embodiment, the method may also include disposing an activator material in the at least one cavity, disposing a plurality of chemiluminescent material particles in the plurality of microcapsules, wherein an application of pressure on the chemilumiscent material causes the activator material to react with at least one of the plurality of chemiluminescent particles to cause formation of an illumination. Optionally, the plurality of microcapsules produce a plurality of different colors of chemiluminescence, and disposing the plurality of microcapsules in the at least one cavity comprises disposing the plurality of microcapsules in the at least one cavity to correspond to the first plurality of regions such that that one or more colors of chemiluminescence are produced upon application of pressure at one or more of the plurality of different pressure values in the first plurality of regions.

In at least one embodiment, a method of making a chemiluminescent product container may include creating a chemiluminescent label by creating an outer layer of the chemiluminiscent label, creating a bottom layer of the chemiluminiscent label, fusing the outer layer and the bottom layer to form at least one cavity between the outer layer and the bottom layer, and disposing a plurality of microcapsules in the at least one cavity wherein the outer layer comprises an image with a first plurality of regions. The method further includes affixing the chemiluminescent label to a product container, via the adhesion material. The bottom layer may include an adhesion material on a side not proximate to the outer layer, and the plurality of microcapsules are configured to break at a plurality of different pressure values.

DETAILED DESCRIPTION

Figure 1A:
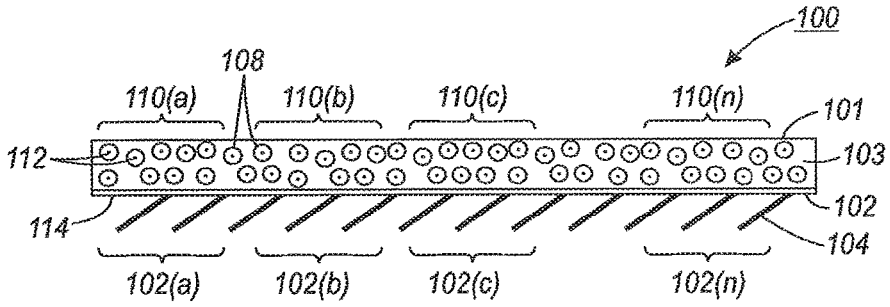
FIG. 1A illustrates a cross-section view of an example of a chemiluminescent label, according to an embodiment.

This disclosure is not limited to the particular systems, methodologies or protocols described, as these may vary. The terminology used in this description is for the purpose of describing the particular versions or embodiments only, and is not intended to limit the scope.

As used in this document, any word in singular form, along with the singular forms "a," "an" and "the," include the plural reference unless the context clearly dictates otherwise. Unless defined otherwise, all technical and scientific terms used in this document have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used in this document, the term "comprising" means "including, but not limited to."

The term "frangible material" refers to material that break upon application of pressure. "Fragility" corresponds to the measure of pressure required to break a frangible material.

Chemical Compositions:

A typical chemiluminescent reaction occurs in a mixture comprising a chemiluminescent compound ("luminiscer"), a fluorescent dye ("dye"), a peroxide, and a solvent. Typically, the luminiscer and the peroxide are separated until the planned illumination. To start the illumination, all reactants are allowed to mix. The minimum starting materials include a solvent, luminiscer (typically an oxalate), dye and a source of peroxide.

Solvent systems for chemiluminescent reactions are well established, and are typically mixtures of dialkyl phthalates (such as dimethyl phthalate, dibutyl phthalate or dioctyl phthalate) and alkyl alcohols (such as t-butyl alcohol). A requirement is that the solvent at least partially dissolves the dye, oxalate and source of peroxide.

The oxalates that can be used in this reaction include, for example: bis(2,6-dichloro-4-nitrophenyl) oxalate, bis (2-carbalkoxy-3,4,6-trichlorophenyl) oxalate, bis(2,4,6-trichlorophenyl) oxalate, bis(3-trifluoromethyl4-nitrophenyl) oxalate, bis(2-methyl-4,6-dinitrophenyl) oxalate, bis(1,2-dimethyl-4,6-dinitrophenyl) oxalate, bis(2,4-dichlorophenyl) oxalate, bis(2,5-dinitrophenyl) oxalate, bis(2-formyl-4-nitrophenyl) oxalate, bis(pentachlorophenyl) oxalate, bis)1,2-dihydro-2-oxo-1-pyridyl) glyoxal, bis-N-phthalmidyl oxalate, bis(2,4,5-trichloro-6-carbopentoxyphenyl) oxalate, bis(2,4,5-trichloro-6-carbobutoxyphenyl) oxalate, bis(2,4,6-trichlorophenyl) oxalate, bis(2,4,5-trichloro-6-carbopentoxyphenyl) oxalate, bis(2,4,5-trichloro-6-carbobutoxyphenyl) oxalate and bis(2,4,6-trichlorophenyl) oxalate, bis (3-carbalkoxy-2,4,6-trichlorophenyl) oxalate, bis(4-carbalkoxy-2,3,6-trichlorophenyl)oxalate, bis(3,5-dicarbalkoxy-2,4,6-trichlorophenyl oxalate. Bis(2,3-dicarbalkoxy-4,5,6 trichlorophenyl)oxalate, bis (2,4-dicarbalkoxy-3,5,6-trichlorophenyl) oxalate, bis (2,5-dicarbalkoxy-3,4,6-trichlorophenyl)oxalate, bis(2,6-dicarbalkoxy-3,4,5-trichlorophenyl) oxalate, bis(3-carbalkoxy-2,4,5,6-tetrachlorophenyl)oxalate, bis (2-carbalkoxy-3,4,5,6-tetrachlorophenyl)oxalate, bis(4-carbalkoxy-2,3,5,6-tetrachlorophenyl) oxalate, bis(6-carbalkoxy-2,3,4-trichlorophenyl) oxalate, bis(2,3,-dicarbalkoxy-4,6-dichlorophenyl) oxalate, bis(3,6-dicarbalkoxy-2,4-dichlorophenyl) oxalate, bis(2,3,5-tricarbalkoxy-4,6-dichlorophenyl) oxalate, bis(3,4,5-tricarbalkoxy-2,6-dichlorophenyl) oxalate, bis(2,4,6-tricarbalkoxy-3,5-dichlorophenyl) oxalate, bis(3-bromo-6-carbohexoxy-2,4,5-trichlorophenyl) oxalate, bis(bis(3-bromo-2-carbethoxy-4,6-dichlorophenyl) oxalate, bis(2-carbethoxy4,6-dichloro-3-nitrophenyl) oxalate, bis {2-carbomethoxy-4,6-dichloro-3-(trifluoromethyl)phenyl} oxalate, bis(2-carbobutoxy-4,6-dichloro-3-cyanophenyl) oxalate, bis(2-carboctyloxy-4,5,6-trichloro-3-ethoxyphenyl) oxalate, bis(2-carbobutoxy-3,4,6-trichloro-5-ethoxphenyl) oxalate, bis(2-carbisopropoxy-3,4,6-trichloro-5-methylphenyl) oxalate, bis(2-carbisopropoxy-4,6-dichloro-5 octylphenyl) oxalate, bis[2-carbomethoxy-3,5,6-trichloro-4-(1,1,3,3-tetramethylbutyl)-phenyl] oxalate, bis{2-[carbobis(trifluoromethyl) methoxy]-3,4,5,6-tetrafluorophenyl} oxalate, bis(3,4,6-tribromo-2-carbocyclohexoxyphenyl) oxalate, bis(2,4,5-tribromo-6-carbophenoxy-3-hexadecylphenyl) oxalate, bis(2,4,5-trichloro-6-carbobutoxyphenyl)oxalate and bis (2,4,5-trichloro-6-carbopentoxyphenyl) oxalate. Other known oxalates are within the scope of this disclosure.

Dyes allow the wavelength of the emitted light during chemiluminescence to be shifted to produce different colors of illumination. There are many dyes that can be used, each yielding a different color of light. Examples may include, without limitation, coumarins such as ambelliferone; xanthenes such as florescence and rhodamine (rhodamine 6G produces orange light and rhodamine B produces red light); squarates; substituted anthracenes such as 9,10-bis-(phenylethynyl) anthracene (blue light), 1-methyl-9,10-bis-(phenylethynyl) anthracene (green light), 1-chloro-9,1-bis-(phenylethynyl) anthracene, 9,10-bis(4-methoxyphenyl)-2-chloroanthacene, and 9,10-bis(4-ethoxyphenyl)-2-chloroanthacene; 16,17-didecycloxyviolanthrone, LUMOGEN RED™ (a red-emitting perylene dicarboximide fluorescer), LUMOGEN YELLOW™ (a yellow-emitting perylene dicarboximide fluorescer), LUMOGEN ORANGE™ (an orange-emitting perylene dicarboximide fluorescer), LUMINOL (a blue-emitting 5-Amino-2,3-dihydro-1,4-phthalazinedione)5,12-bis-(phenylethynyl) napthacene, 5,16,11,12-tetraphenylnapthacene, and combinations thereof.

The general class of common hydroperoxides can be represented by the formula R(OOH)z, wherein R generally is a hydrocarbon group containing up to about 18 carbon atoms, and z is 1, 2 or 3. In one embodiment, z is 1 and R is a an alkyl, aryl or aralyl hydrocarbon group containing from about 3 to about 12 carbon atoms. Examples of peresters include t-butylperacetate, t-butyl peroxyisoburyrate; di-t-butyl diperphthalate, t-butyl berbenzoate, 2,5-dimethyl-2,5-bis(benzoylperoxy) hexane, t-butyl peroxymaleic acid and combinations thereof.

By means of appropriate doses of the different reactants, it is possible to adjust the duration, color, and intensity of illumination. The peroxide component acts as an activator for the reaction, and may be latent, in which case it may need a transition metal to switch it to an active oxidizer upon contact. Before the desired illumination, the peroxide is separated from the remaining reactants.

Figure 1B:
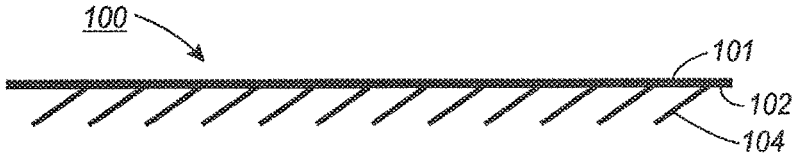
FIG. 1B illustrates a top view of the chemiluminescent label of FIG. 1, according to an embodiment.

Referring now to FIG. 1A and FIG. 1B, a chemiluminescent label of the current disclosure may include a flexible label 100 that may be folded in three dimensions to form various shapes. In an embodiment, the label may include a top layer 101 formed from a transparent or translucent material. Examples of the top layer material may include, without limitation, a polymer such as polyethylene, polypropylene, mylar, other PET materials, polycarbonates, silica particulates, etc. In certain embodiments, the top layer material may be transparent. Alternatively and/or additionally, surface irregularities may be used to diffuse emitted light to create a "frosted effect." In yet another embodiment, visual effects of the top layer may be improved by molding or etching reflective structures and/or geometric patterns such as Fresnel lens effect, prismatic structures, etc.

The label may also include an impermeable bottom layer 102 such that the top layer 101 and the impermeable bottom layer 102 may form a cavity 103 disposed between the two layers. Examples of the bottom layer material may include, without limitation, polymeric films (as discussed above), non-reactive or passivated metal foils, etc. in certain embodiments, the bottom layer material may be reflective to maximize the fraction of generated light that reaches the top of the label. In yet another embodiment, visual effects of the bottom layer may be improved by molding or etching reflective structures and/or geometric patterns such as Fresnel lens effect, prismatic structures, etc. For connecting or sealing the two layers, techniques known in the art may be used, including welding, soldering, heat sealing, gluing, vacuum sealing etc. The bottom layer may include different regions 102(*a*), 102(*b*), 102(*c*), etc. as discussed below.

In an embodiment, the top layer 101 may include a plurality of images 110(*a*), 110(*b*), 110(*c*), etc. that may enhance the appeal of the product to a customer. In certain embodiments, the plurality of images may include different colors. It will be understood to those skilled in the art that the plurality of images may be customized to the target product and/or customers without deviating from the principles of this disclosure. In some embodiments, the top layer may also include directions to a user to make the chemiluminescent label user interactive. For example, the directions may include, without limitations, an explanation of the label and its features, user interactive features such as arrows or other pointers directing a user to press at certain points on the label, games or puzzles using the chemiluminescence features of the label (as discussed below).

In certain embodiments, the bottom layer 102 may be frangible such that it may break upon application of pressure. Examples of the frangible bottom layer material may include, without limitation polymeric films, metalized polymeric films (such as mylar, polyethylene, etc.), metal foils, ceramic films, glass, etc. In one embodiment, the bottom layer 102 may also include an adhesive material 104 on a side distal to the top layer 101. Examples of adhesives may include, without limitation, synthetic rubber-based adhesives, natural rubber-based adhesives, vinyl ether adhesive, acrylate adhesive, methacrylate adhesive, urethane adhesive, epoxy-based adhesive, silicone adhesives, and mixtures thereof. The acrylate adhesive may be, for example, a tri-functional acrylate monomer based on a glycerol derivative.

In one aspect of the disclosure, the adhesive material 104 may include a chemiluminescent compound and may also include a dye compound. The chemiluminescent compound and/or the dye compound may be mixed in the adhesive compound before coating on the bottom layer 102. Additionally and/or optionally, the chemiluminescent compound and/or the dye compound may be coated after the application of the adhesive on the bottom layer 102.

In an embodiment, the cavity 103 may include the peroxide source in dry form or dissolved in a suitable solvent. In an embodiment, the frangible bottom layer 102 may break upon application of suitable pressure to bring the peroxide activator in contact with the chemiluminescent compound and/or the dyes compound to produce illumination. In some embodiments, the frangible bottom layer may include different regions of different fragility (102(*a*), 102(*b*), 102(*c*), etc.), such that the regions of different fragility may break at different pressures. In an embodiment, same frangible material of differing thickness may be fused to create different regions of different fragility. Alternatively and/or additionally, different materials of different fragility may be fused to create different regions of different fragility. The different regions of different fragility may be fused using techniques known to those skilled in the art such as adhesives, fitting into slots made from a host material, etc.

In an embodiment, the regions of different fragility may be coated with different color dyes and/or different amounts of chemiluminescent compound and dyes, such that different pressure applications may produce different color and/or intensity of illuminations. Furthermore, the regions of different fragility may be distributed or incorporated so as to correspond to the images and/or user interactive features of the top layer 101. In an embodiment, the presence of two different dyes at two different regions of differing and/or same fragility can appear as two spots on the outer surface of the device having a different color. For example, region 102(*a*) with a first fragility value may break to yield a red color chemiluminescence at a first pressure value, region 102(*b*) with a second fragility value may break to yield a blue color chemiluminescence at a second pressure value (different from the first pressure value). Similarly, a difference between concentrations of the reactants at two different regions of differing and/or same fragility may appear as two spots of different brightness.

Alternatively and/or additionally, in an embodiment, the different regions 102(*a*), 102(*b*), 102(*c*), etc., may have the same fragility value. The different regions may be coated with different with different color dyes and/or different amounts of chemiluminescent compound and dye such that application of a single pressure value may produce regions with different color and/or intensity of illuminations.

In a second aspect of the disclosure, the adhesive material 104 may include the peroxide compound 114 as illustrated by FIG. 1A. The peroxide compound may be mixed in the adhesive compound before coating on the bottom layer 102. Additionally and/or optionally, the peroxide compound may be coated after the application of the adhesive on the bottom layer 102. In an embodiment, the peroxide compound may be in a latent state and the activator transition metal may be disposed on the cavity side of the bottom layer 102.

In an embodiment, the cavity 103 may include the chemiluminescent compound 112 and/or the dye compound in dry form coated on the cavity side of the bottom layer 102 and/or the top layer 101. As discussed above, the frangible bottom layer 102 may break upon application of suitable pressure to bring the peroxide activator in contact with the chemiluminescent compound and/or the dyes compound to produce illumination. In some embodiments, the frangible bottom layer may include different regions of different fragility (102(*a*), 102(*b*), 102(*c*), etc.), such that the regions of different fragility may break at different pressures. In an embodiment, the regions of different fragility may be coated with different color dyes and/or different amounts of chemiluminescent compound and dyes, such that different pressure applications may produce different color and/or intensity of illuminations. Furthermore, the regions of different fragility may be distributed or incorporated so as to correspond to the images and/or user interactive features of the top layer 101. In an embodiment, the presence of two different dyes at two different regions of differing and/or same fragility can appear as two spots on the outer surface of the device having a different color. For example, region 102(*a*) with a first fragility value may break to yield a red color chemiluminescence at a first pressure value, region 102(*b*) with a second fragility value may break to yield a blue color chemiluminescence at a second pressure value (different from the first pressure value). Similarly, a difference between concentrations of the reactants at two different regions of differing and/or same fragility may appear as two spots of different brightness.

Alternatively and/or additionally, in an embodiment, the different regions 102(*a*), 102(*b*), 102(*c*), etc., may have the same fragility value. The different regions may be coated with different with different color dyes and/or different amounts of chemiluminescent compound and dye such that application of a single pressure value may produce regions with different color and/or intensity of illuminations.

In yet another aspect of the disclosure, the adhesive material 104 may include the peroxide compound 114 (as discussed above), and the cavity 103 may include the chemiluminescent compound and/or the dye compound microencapsulated in a suitable solvent, using techniques known in the art. The number of the microcapsules 108 may vary depending on the quantity of the reactants required to produce the desired intensity of illumination. The microcapsule 108 may have a form of a bubble, ampoule, a hollow grain, and may comprise thin glass, polymer, metal foil laminated with a polymer, or other materials that are inert and insoluble in the inner environment of the device. In an embodiment, the size of the microcapsules 108 may be from about 0.2 μm to about 10,000 μm.

In an embodiment, the fragility of the microcapsules 108 may be varied such that different volumes and colors of the chemiluminescent compound 112 and/or the dye compound may be released into the cavity 103 at different pressure (by rupturing the microcapsules 108). The fragility of the microcapsules 108 may be chosen such that it is at least less than or equal to the fragility of the bottom layer 102 to ensure that the bottom layer breaks in conjunction with the rupture of the microcapsules 108. As discussed above, the frangible bottom layer 102 may break upon application of suitable pressure to bring the peroxide activator 114 (from the adhesive) in contact with the chemiluminescent compound 112 and/or the dyes compound (from the microcapsules) to produce illumination.

In an embodiment, the microcapsules 108 of different fragility may include different color dyes such that different pressure applications may produce different color. Furthermore, the number of microcapsules 108 of each different fragility value may be varied to vary the intensity of illuminations. For example, microcapsules 108 dispersed in region 102(*a*) of the bottom layer, with a first fragility value, may include a red color dye, microcapsules 108 dispersed in region 102(*b*) of the bottom layer, with a second fragility value, may include a blue color dye, and microcapsules 108 dispersed in region 102(*c*) of the bottom layer, with a third fragility value, may include a yellow color dye, such that application of a first pressure value may yield a red chemiluminescence, application of a second pressure value may yield a blue chemiluminescence, and application of a third pressure value may yield a yellow chemiluminescence.

In certain other embodiments, the microcapsules 108 dispersed in different regions may include different amounts of the same and/or different color chemiluminescent compound 112 and/or the dye compound, to produce different intensities of illumination at different pressure values. In yet another embodiment, the number of microcapsules 108 dispersed in different regions may be varied to produce different intensities of illumination at different pressure values. For example, the number of microcapsules in region 102(*a*) of the bottom layer may be different from the number of microcapsules in region 102(*b*) of the bottom layer.

Alternatively and/or additionally, in an embodiment, the different regions 102(*a*), 102(*b*), 102(*c*), etc., may have the same fragility value. The microcapsules 108 with different color dyes and/or different amounts of chemiluminescent compound and dyes may be dispersed on the bottom layer such that application of a single pressure value may produce regions with different color and/or intensity of illuminations.

In an embodiment, the microcapsules 108 of different fragility may be distributed or incorporated in the cavity 103 to correspond to the images and/or user interactive features of the top layer 101.

In another aspect, the chemiluminescent label of the current disclosure the cavity 103 may include the chemiluminescent compound and/or the dye compound microencapsulated in a suitable solvent, as well as the peroxide compound. Upon application of suitable pressure, the microcapsules 108 may break to bring the peroxide activator in contact with the chemiluminescent compound and/or the dyes compound (from the microcapsules 108) to produce chemiluminescence.

In an embodiment, the fragility of the microcapsules 108 may be varied such that different volumes and colors of the chemiluminescent compound and/or the dye compound may be released into the cavity 103 at different pressure (by rupturing the microcapsules).

In an embodiment, the microcapsules 108 of different fragility may include different color dyes such that different pressure applications may produce different color. Furthermore, the number of microcapsules of each different fragility value may be varied to vary the intensity of illuminations. For example, microcapsules 108 dispersed in region 102(*a*) of the bottom layer, with a first fragility value, may include a red color dye, microcapsules 108 dispersed in region 102(*b*) of the bottom layer, with a second fragility value, may include a blue color dye, and microcapsules 108 dispersed in region 102(*c*) of the bottom layer, with a third fragility value, may include a yellow color dye, such that application of a first pressure value may yield a red chemiluminescence, application of a second pressure value may yield a blue chemiluminescence, and application of a third pressure value may yield a yellow chemiluminescence.

In certain other embodiments, the microcapsules 108 dispersed in different regions may include different amounts of the same and/or different color chemiluminescent compound and/or the dye compound, to produce different intensities of illumination at different pressure values. In yet another embodiment, the number of microcapsules 108 dispersed in different regions may be varied to produce different intensities of illumination at different pressure values. For example, the number of microcapsules 108 in region 102(*a*) of the bottom layer may be different from the number of microcapsules 108 in region 102(*b*) of the bottom layer.

The microcapsules 108 may all have the same fragility value and may include different color dyes and/or different amounts of chemiluminescent compound and dye such that application of a single pressure value may produce regions with different color and/or intensity of illuminations.

In an embodiment, the microcapsules 108 of different fragility may be distributed or incorporated in the cavity 103 to correspond to the images and/or user interactive features of the top layer 101.

Figure 2A:
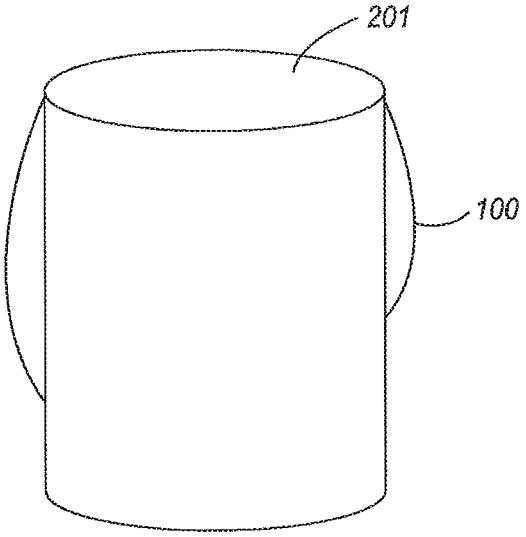
FIG. 2A depicts a chemiluminescent label of the current disclosure affixed to a beverage container.
Figure 2B:
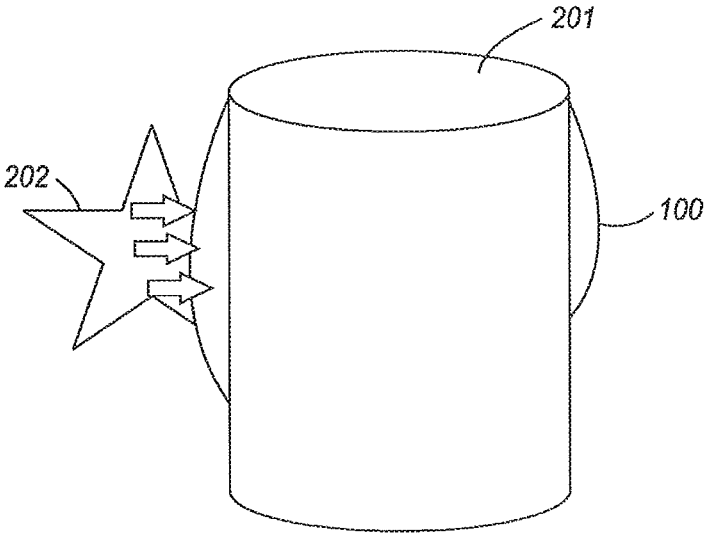
FIG. 2B illustrates the illumination of a chemiluminescent label in response to user interaction.

FIG. 2A illustrates the chemiluminescent label 100 of the current disclosure affixed to a container 201 via the adhesive material 104 such that the top layer lies on the outside. FIG. 2B illustrates the illumination 202 of the chemiluminescent label 100 upon application of suitable pressure.

Figure 3:
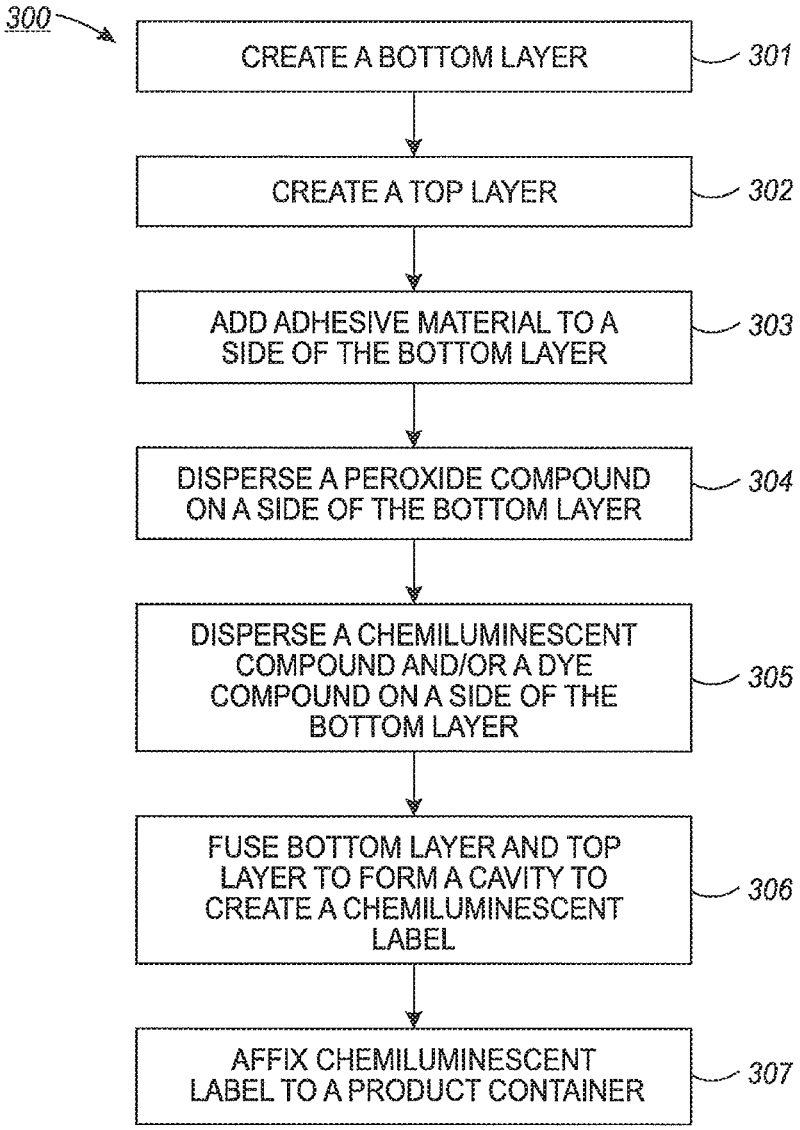
FIG. 3 illustrates a flowchart of an example method of manufacturing a chemiluminescent label, according to an embodiment.

FIG. 3 illustrates an example flowchart method of producing the chemiluminescence label described above. In step 301, an impermeable bottom layer may be created. In certain embodiments, the bottom layer may include different regions of different fragility values. In step 302, a transparent or semi-transparent top layer may be created such that the top layer includes a plurality of images and/or user-interactive features. An adhesive material may be applied 303 to one side of the bottom layer. In an embodiment, a peroxide (activator) compound may be dispersed 304 on one side of the bottom layer. In step 305, at least one chemiluminescent compound and/or at least one dye compound may be dispersed on a side of the bottom layer that does not include the peroxide compound. In certain embodiments, the chemiluminescent compound and/or the at least one dye compound may be microencapsulated before dispersing on the bottom layer. In an embodiment, the microcapsules may be dispersed on the side of the bottom layer that includes the peroxide compound, but does not include the adhesive material. In step 306, a chemiluminescent label may be created by fusing the top layer and the bottom layer to form a cavity such that the adhesion material lies outside the cavity. In an embodiment, the chemiluminescent label of step 306 may be affixed 307 on a product container via the adhesive material.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A method of making a chemiluminescent label, the method comprising:

creating an outer layer of the chemiluminiscent label, wherein the outer layer comprises an image with a first plurality of regions;

creating a bottom layer of the chemiluminiscent label, wherein:

the bottom layer comprises an adhesion material on a side not proximate to the outer layer, and a second plurality of regions corresponding to the first plurality of regions that are configured to break at a plurality of different pressure values and produce an illumination; and fusing the outer layer and the bottom layer to form at least one cavity between the outer layer and the bottom layer.

2. The method of claim 1, further comprising affixing the chemiluminescent label to a product container, via the bottom layer.

3. The method of claim 1, wherein creating the outer layer further comprises customizing the first plurality of regions based on at least one of the following: a product, a customer base, or a plurality user interactive features.

4. The method of claim 1, further comprising:

disposing an activator material on the side of the bottom layer comprising the adhesion material; and dispersing a plurality of chemiluminescent material particles in the at least one cavity.

5. The method of claim 4, wherein the chemiluminiscent label is configured to form the illumination comprising at least one color in at least one of the first plurality of regions by application of pressure on at least one of the second plurality of regions that causes the activator material to react with at least one of the plurality of chemiluminescent particles.

6. The method of claim 4, wherein dispersing the plurality of chemiluminescent material particles in the at least one cavity comprises dispersing the plurality of chemiluminescent material particles in the at least one cavity to correspond to the second plurality of regions such that one or more colors of chemiluminescence are produced upon application of pressure at one or more of the plurality of different pressure values in the first plurality of regions.

7. The method of claim 1, further comprising:

disposing an activator material in the at least one cavity; and dispersing a plurality of chemiluminescent material particles on the bottom layer on the side comprising the adhesion material.

8. A method of making a chemiluminescent label, the method comprising:

creating an outer layer of the chemiluminiscent label, wherein the outer layer comprises an image with a first plurality of regions;

creating a bottom layer of the chemiluminiscent label, wherein the bottom layer comprises an adhesion material on a side not proximate to the outer layer;

fusing the outer layer and the bottom layer to form at least one cavity between the outer layer and the bottom layer; and disposing a plurality of microcapsules in the at least one cavity, wherein the plurality of microcapsules are configured to break at a plurality of different pressure values and produce an illumination.

9. The method of claim 8, further comprising:

disposing an activator material on the side of the bottom layer comprising the adhesion material; and disposing a plurality of chemiluminescent material particles in the plurality of microcapsules, wherein an application of pressure on the chemilumiscent material causes the activator material to react with at least one of the plurality of chemiluminescent particles to cause formation of the illumination.

10. The method of claim 9, wherein:

the plurality of microcapsules produce a plurality of different colors of chemiluminescence, and disposing the plurality of microcapsules in the at least one cavity comprises disposing the plurality of microcapsules in the at least one cavity to correspond to the first plurality of regions such that that one or more colors of chemiluminescence are produced upon application of pressure at one or more of the plurality of different pressure values in the first plurality of regions.

11. The method of claim 8, further comprising:

disposing an activator material in the at least one cavity; and disposing a plurality of chemiluminescent material particles in the plurality of microcapsules, wherein an application of pressure on the chemilumiscent material causes the activator material to react with at least one of the plurality of chemiluminescent particles to cause formation of the illumination.

12. The method of claim 11, wherein:

the plurality of microcapsules produce a plurality of different colors of chemiluminescence, and disposing the plurality of microcapsules in the at least one cavity comprises disposing the plurality of microcapsules in the at least one cavity to correspond to the first plurality of regions such that that one or more colors of chemiluminescence are produced upon application of pressure at one or more of the plurality of different pressure values in the first plurality of regions.

13. The method of claim 8, wherein the bottom layer comprises a plurality of regions that break at a plurality of different pressure values.

14. A method of making a chemiluminescent product container, the method comprising:

creating a chemiluminescent label by:

creating an outer layer of the chemiluminiscent label, wherein the outer layer comprises an image with a first plurality of regions, creating a bottom layer of the chemiluminiscent label, wherein the bottom layer comprises an adhesion material on a side not proximate to the outer layer, fusing the outer layer and the bottom layer to form at least one cavity between the outer layer and the bottom layer, and disposing a plurality of microcapsules in the at least one cavity, wherein the plurality of microcapsules are configured to break at a plurality of different pressure values and produce an illumination; and affixing the chemiluminescent label to a product container, via the adhesion material.

15. The method of claim 14, further comprising:

disposing an activator material on the side of the bottom layer comprising the adhesion material; and disposing a plurality of chemiluminescent material particles in the plurality of microcapsules, wherein an application of pressure on the chemilumiscent material causes the activator material to react with at least one of the plurality of chemiluminescent particles to cause formation of the illumination.

16. The method of claim 15, wherein:

the plurality of microcapsules produce a plurality of different colors of chemiluminescence, and disposing the plurality of microcapsules in the at least one cavity comprises disposing the plurality of microcapsules in the at least one cavity to correspond to the first plurality of regions such that that one or more colors of chemiluminescence are produced upon application of pressure at one or more of the plurality of different pressure values in the first plurality of regions.

17. The method of claim 14, further comprising:

disposing an activator material in the at least one cavity; and disposing a plurality of chemiluminescent material particles in the plurality of microcapsules, wherein an application of pressure on the chemilumiscent material causes the activator material to react with at least one of the plurality of chemiluminescent particles to cause formation of the illumination.

18. The method of claim 17, wherein:

the plurality of microcapsules produce a plurality of different colors of chemiluminescence, and disposing the plurality of microcapsules in the at least one cavity comprises disposing the plurality of microcapsules in the at least one cavity to correspond to the first plurality of regions such that that one or more colors of chemiluminescence are produced upon application of pressure at one or more of the plurality of different pressure values in the first plurality of regions.

* * * * *